US008176708B2

(12) United States Patent
Nozaki

(10) Patent No.: US 8,176,708 B2
(45) Date of Patent: May 15, 2012

(54) TOP BOARD STRUCTURE

(75) Inventor: Osamu Nozaki, Higashiosaka (JP)

(73) Assignee: Okamura Corporation (JP)

( * ) Notice: Subject to any disclaimer, the term of this patent is extended or adjusted under 35 U.S.C. 154(b) by 321 days.

(21) Appl. No.: 12/438,611

(22) PCT Filed: Aug. 24, 2007

(86) PCT No.: PCT/JP2007/066454

§ 371 (c)(1),
(2), (4) Date: Feb. 24, 2009

(87) PCT Pub. No.: WO2008/023794

PCT Pub. Date: Feb. 28, 2008

(65) Prior Publication Data

US 2010/0239806 A1 Sep. 23, 2010

(30) Foreign Application Priority Data

Aug. 25, 2006 (JP) ..... 2006-229791

(51) Int. Cl.
*E04C 2/32* (2006.01)

(52) U.S. Cl. ..... 52/783.17; 52/36.4; 52/783.11; 52/783.18; 52/783.19

(58) Field of Classification Search ..... 52/783.17, 52/783.11, 783.18, 783.19, 36.4, 784.12, 52/784.13, 792.1, 792.11; 108/153.1, 180; 248/346.01, 346.02, 678
See application file for complete search history.

(56) References Cited

U.S. PATENT DOCUMENTS 2,575,454 A * 11/1951 Kuhler ..... 105/397
4,941,304 A * 7/1990 Lewellin ..... 52/580
7,506,484 B2 * 3/2009 Geller ..... 52/784.1

FOREIGN PATENT DOCUMENTS

| | | | |
|---|---|---|---|
| JP | 2002-085212 | A | 3/2002 |
| JP | 2002-315630 | A | 10/2002 |
| JP | 2003-174935 | A | 6/2003 |
| JP | 2004-261388 | A | 9/2004 |
| JP | 2005-137714 | A | 6/2005 |

OTHER PUBLICATIONS

International Search Report dated Nov. 27, 2007, issued in corresponding international application No. PCT/JP2007/066454.

* cited by examiner

*Primary Examiner* — William Gilbert
*Assistant Examiner* — Patrick Maestri
(74) *Attorney, Agent, or Firm* — Ostrolenk Faber LLP

(57) ABSTRACT

A top board structure capable of easily and simply assembling and welding a reinforcing frame to a top board body, providing a sufficient strength with a reduced weight, and reducing abnormal noise that might occur when an impact is applied. A reinforcing frame formed by assembling lateral reinforcing member directed in a lateral direction with a longitudinal reinforcing member directed in a longitudinal direction is fixed to the lower surface of a base board in a top board body formed at the peripheral edge thereof in a box shape opened downward by a downward piece, a rear surface cover in a box shape opened upward by an upward piece is formed at the peripheral edge of a cover base board, and the rear surface cover is fixed to the top board body with the upward piece of the rear surface cover kept fitted/inserted into gaps formed between the inside surface of the erect piece portion of the downward piece in the top board body and the outside portion of the reinforcing frame or the inside partition wall of the reinforcing member constituting the reinforcing frame.

7 Claims, 12 Drawing Sheets

TOP BOARD STRUCTURE

CROSS REFERENCE TO RELATED APPLICATIONS

The present application is a 35 U.S.C. §371 National Phase conversion of PCT/JP2007/066454, filed Aug. 24, 2007, which claims benefit of Japanese Application No. 2006-229791, filed Aug. 25, 2006. The PCT International Application was published in the Japanese language.

BACKGROUND OF THE INVENTION

The present invention relates to the top board structure of office furniture such as a table and a desk used in an office.

The top board of a table or a desk is made of wood or a wooden base on which a decoration plate such as melamine resin is applied. To keep sufficient strength, it is necessary to thicken the base. Flexibility in design is not good and its appearance becomes poor. The top board also becomes heavier. It is necessary to strengthen the support structure for the top board.

JP2003-174935A discloses that the top board of a table is made of resin on which Aluminum is applied, but is not preferable in view of environmental aspects such as wastes and recycling.

The top board of a table is made of sheet metal. But if impact is given, abnormal noise is likely to occur. In order to keep sufficient strength, it is necessary to increase thickness of the sheet metal. The top board becomes heavier as well as wooden base.

JP2005-137714A discloses that the top board of the furniture is made of steel sheet metal and reinforced with a core made of the same material thereby reducing its weight, preventing abnormal noise and providing advantages in environmental aspects such as wastes and recycling.

However, in the top board in JP2005-137714A, the core comprises a honeycomb structure. It is very difficult to join an upper plate on a lower plate. Its manufacturing is complicated to increase cost.

SUMMARY OF THE INVENTION

In view of the foregoing disadvantages, it is an object of the invention to provide the top board structure of office furniture in which a reinforcing frame can be assembled and welded more easily, the top board structure providing less weight but sufficient strength, abnormal noise being reduced even if impact is given.

DETAILED DESCRIPTION OF PREFERRED EMBODIMENTS

Figure 1:
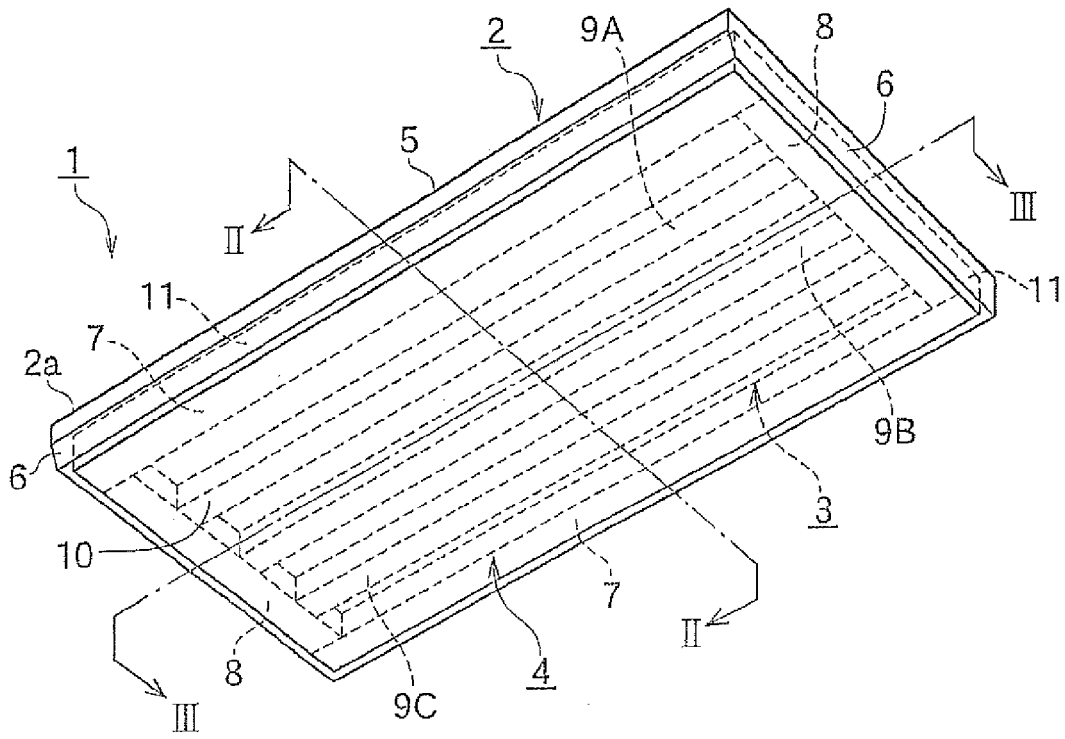
FIG. 1 is a perspective view of the first embodiment of the top board structure according to the present invention, seen from below.
Figure 2:
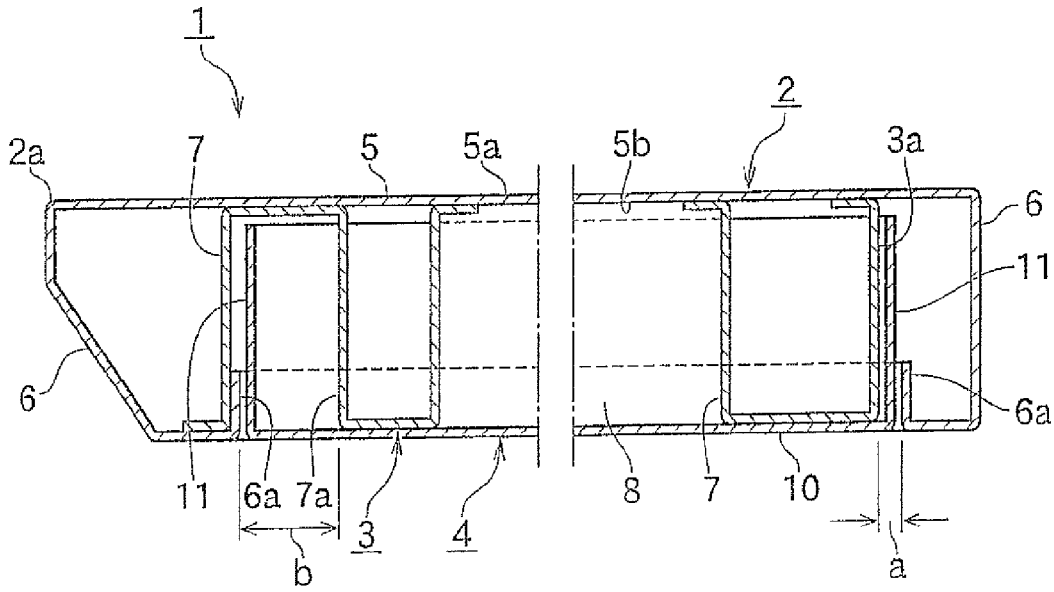
FIG. 2 is a vertical sectional view taken along the line II-II in FIG. 1.
Figure 3:
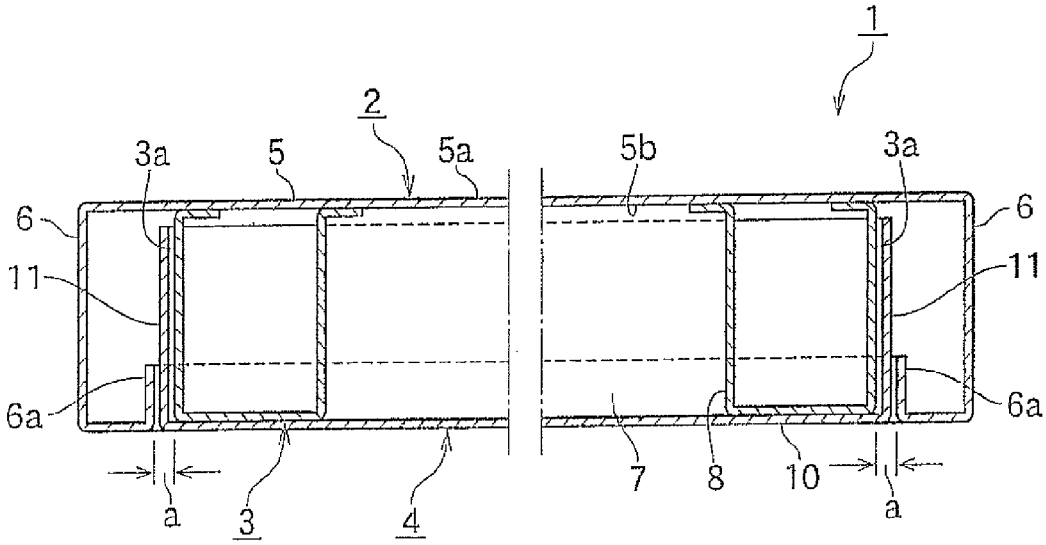
FIG. 3 is a vertical sectional view taken along the line III-III in FIG. 1.

FIG. 1 is an enlarged perspective view of the first embodiment of a top board according to the present invention, seen from below; FIG. 2 is a vertical sectional view taken along the line II-II in FIG. 1; FIG. 3 is a verticals sectional view taken along the line and FIG. 4 is an exploded perspective view showing how to mount a reinforcing frame and a bottom cover to the top board upside down.

In FIG. 1, a top board 1 comprises a top board body 2 on which a computer is placed; a reinforcing frame 3; and a bottom cover 4 made of the same material such as sheet metal.

In FIGS. 2 and 3, the top board body 2 comprises a base 5 the upper surface 5*a* of which is used for working; and a downward portion 6 which extends downward from the outer periphery of the base 5. At the front edge 2*a* of the top board body 2, the downward portion 6 is tilted rearward.

Figure 4:
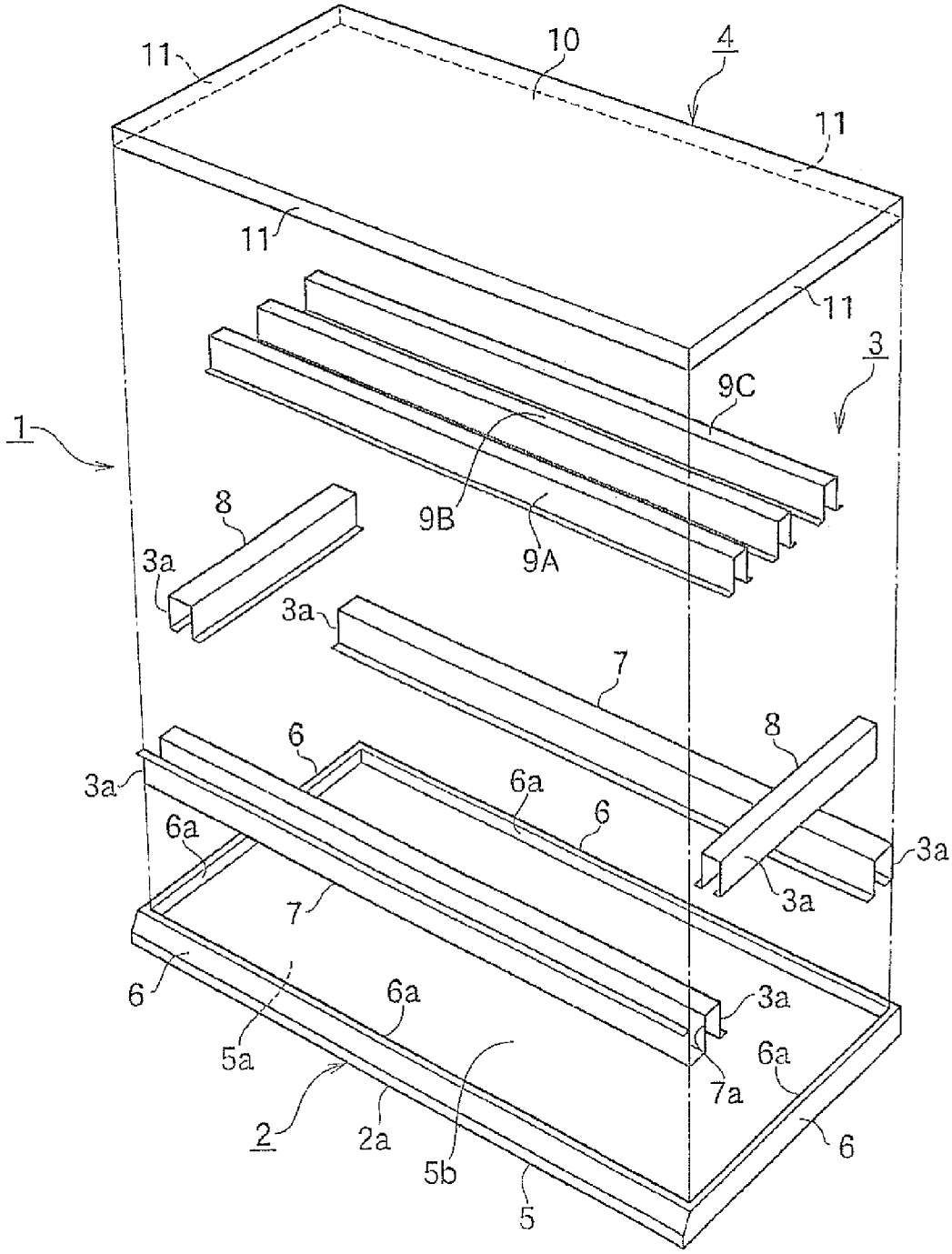
FIG. 4 is an exploded perspective view showing a reinforcing frame and a bottom cover upside down.

In FIG. 4, the reinforcing frame 3 comprises a longitudinal reinforcement 7 extending along the periphery in a right and left direction; and a lateral reinforcement 8 extending in a forward and backward direction. In the frame 3, three longitudinal intermediate reinforcements 9A,9B,9C are disposed.

The reinforcements 7,8,9A,9B,9C are fixed on the lower surface 5*b* of the base 5 of the top board body 2 by spot welding to form the reinforcing frame 3.

In FIGS. 2 and 3, there is a gap "a" between the the outer side 3*a* of the reinforcing frame 3 and the inner side of a standing portion 6*a* of the downward portion 6 except parts along the front edge 2*a* of the top board body 2. The gap "a" is slightly wider than the thickness of the upward portion 11.

Furthermore, in FIG. 2, there is a gap "b" between the inner side of the standing portion 6*a* of the downward portion 6 of the top board body 2 and an inner partition wall 7*a* of the longitudinal reinforcement 7 forming the front edge of the reinforcing frame 3. The upward portion 11 of the bottom cover 4 is disposed in the gap "b". A flange 6*b* extends between the downward portion 6 and the standing portion 6*a*.

The gap "b" may be slightly wider than the thickness of the upward portion 11 of the bottom cover 4 as well as the gap "a".

The bottom cover 4 is formed like a box having an upper opening with a cover base 10 and the upward portion 11 standing upward from the periphery of the cover base 10.

In FIGS. 2 and 3, the upward portion 11 is disposed in the gaps "a" and "b" and mounted to the top board body 2.

In order to assemble the top board 1 in the first embodiment of the present invention, the reinforcing frame 3 is fixed on the lower surface of the top board body 2 by spot welding in FIG. 4. Then, the upward portion 11 of the bottom cover 4 is put in the gap "a" between the top board body 2 and the reinforcing frame 3, and the bottom cover 4 is fixed to the reinforcing frame 3 by spot welding.

In this embodiment, the reinforcing frame 3 is fixed to the lower surface 5*b* of the base 5 of the box-like top board body 2 having a lower opening, and the bottom cover 4 is fixed to the top board body 2 while the upward portion 11 of the bottom cover 11 is disposed in the gaps "a" and "b" thereby facilitating assembling and welding of the bottom cover 4 to the top board body 2.

The reinforcing frame 3 is fixed to the lower surface 5*b* of the base 5 of the top board body 2 thereby making the base 5 of the top board body 2 thinner, reducing the total weight and providing sufficient strength as the top board 1.

Even if impact is given, the reinforcements 7,8 of the reinforcing frame 3 will absorb vibration thereby reducing abnormal noise. The top board body 2, the reinforcing frame 3 and the bottom cover 4 are made of the same material which is preferable in view of environmental aspects such as wastes and recycling.

Furthermore, the reinforcing frame 3 is covered with the bottom cover 4 mounted to the lower surface of the top board body 2, so that the reinforcing frame 3 is stored within the top board 1 in good appearance.

Figure 5:
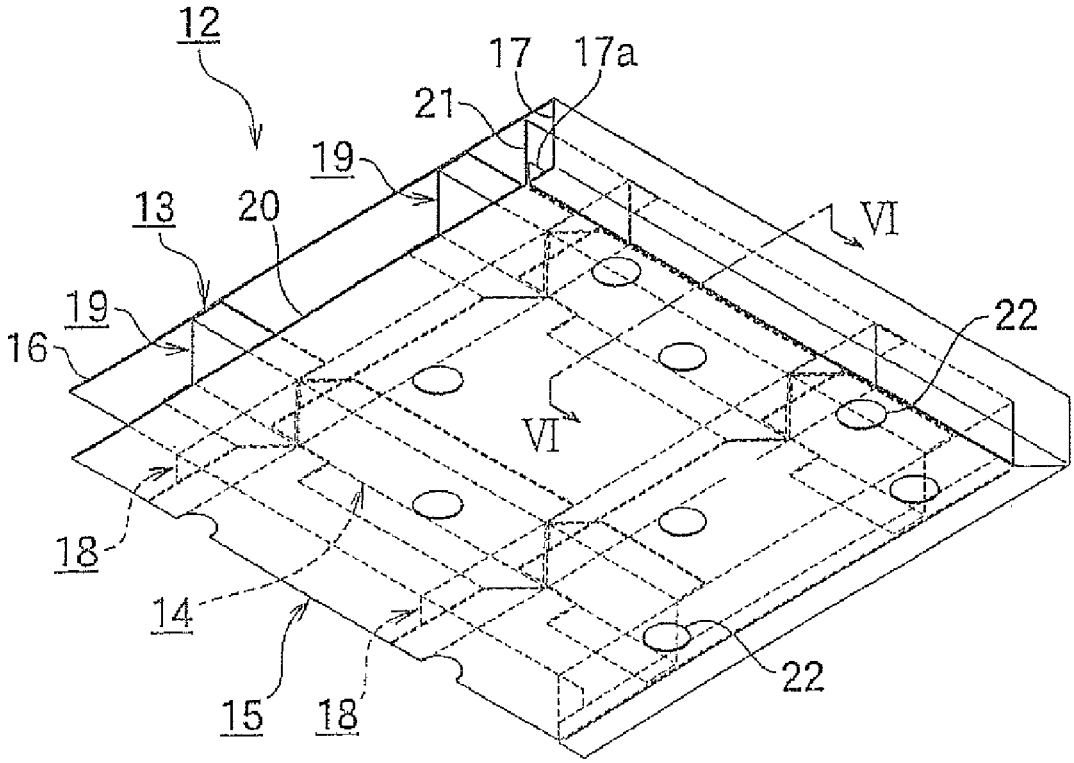
FIG. 5 is a perspective view showing the second embodiment of the top board structure according to the present invention, seen from below.
Figure 6:
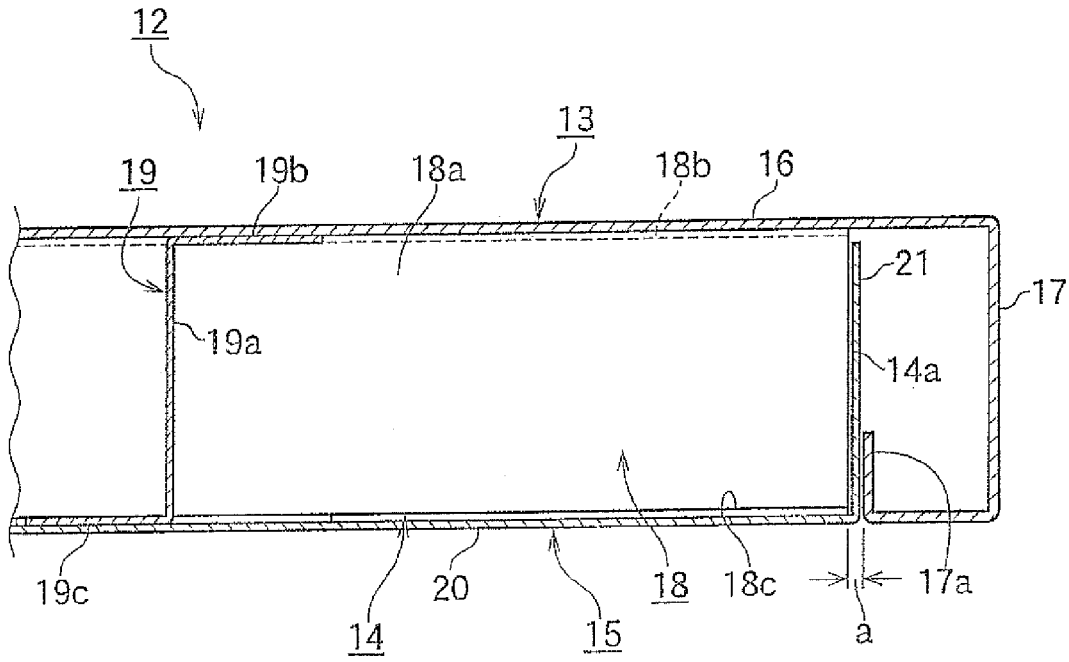
FIG. 6 is a vertical sectional view taken along the line VI-VI in FIG. 5.
Figure 7:
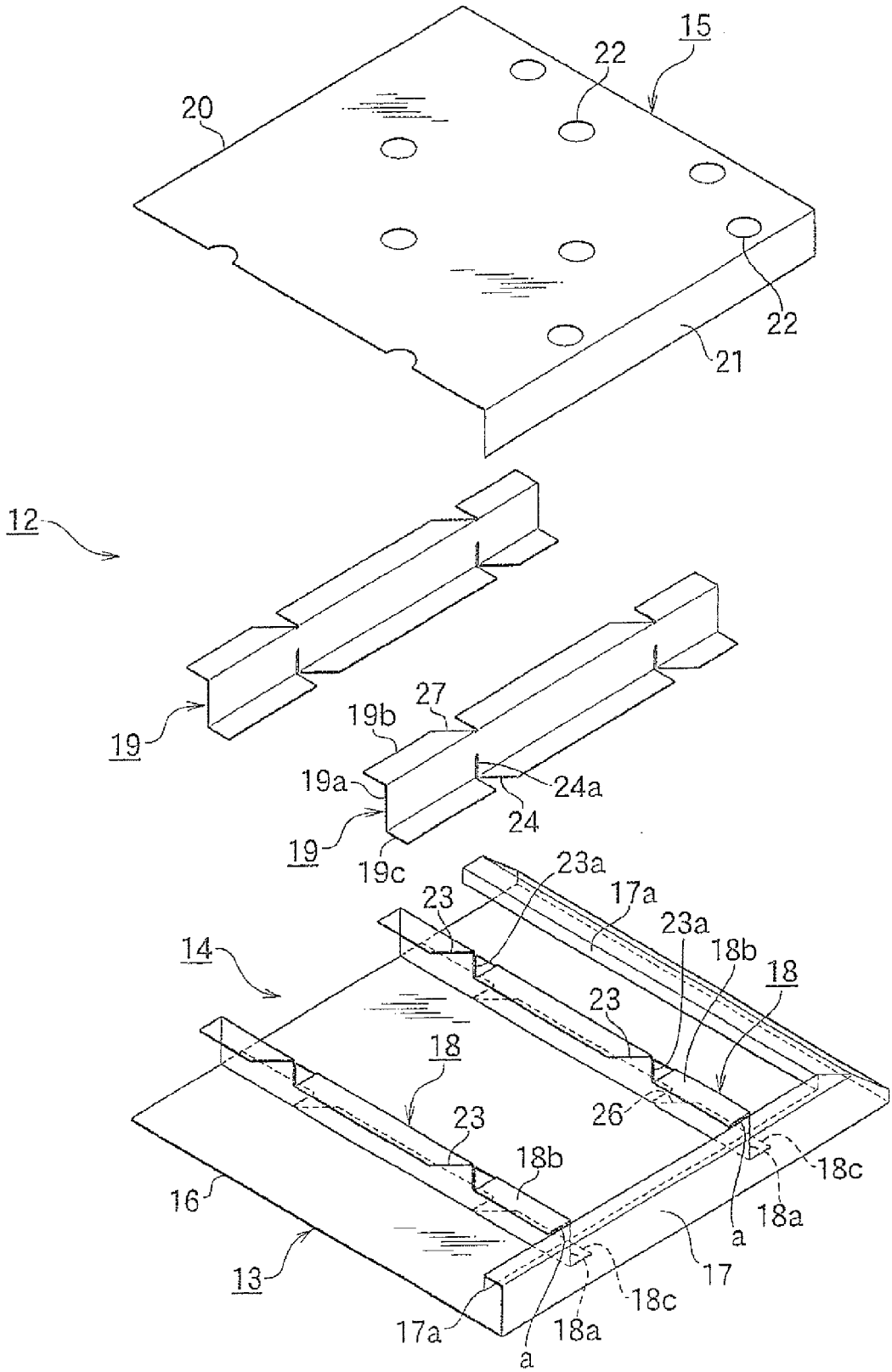
FIG. 7 is an exploded perspective view showing how to mount the reinforcing frame and bottom cover to the top board in FIG. 5 upside down.
Figure 8:
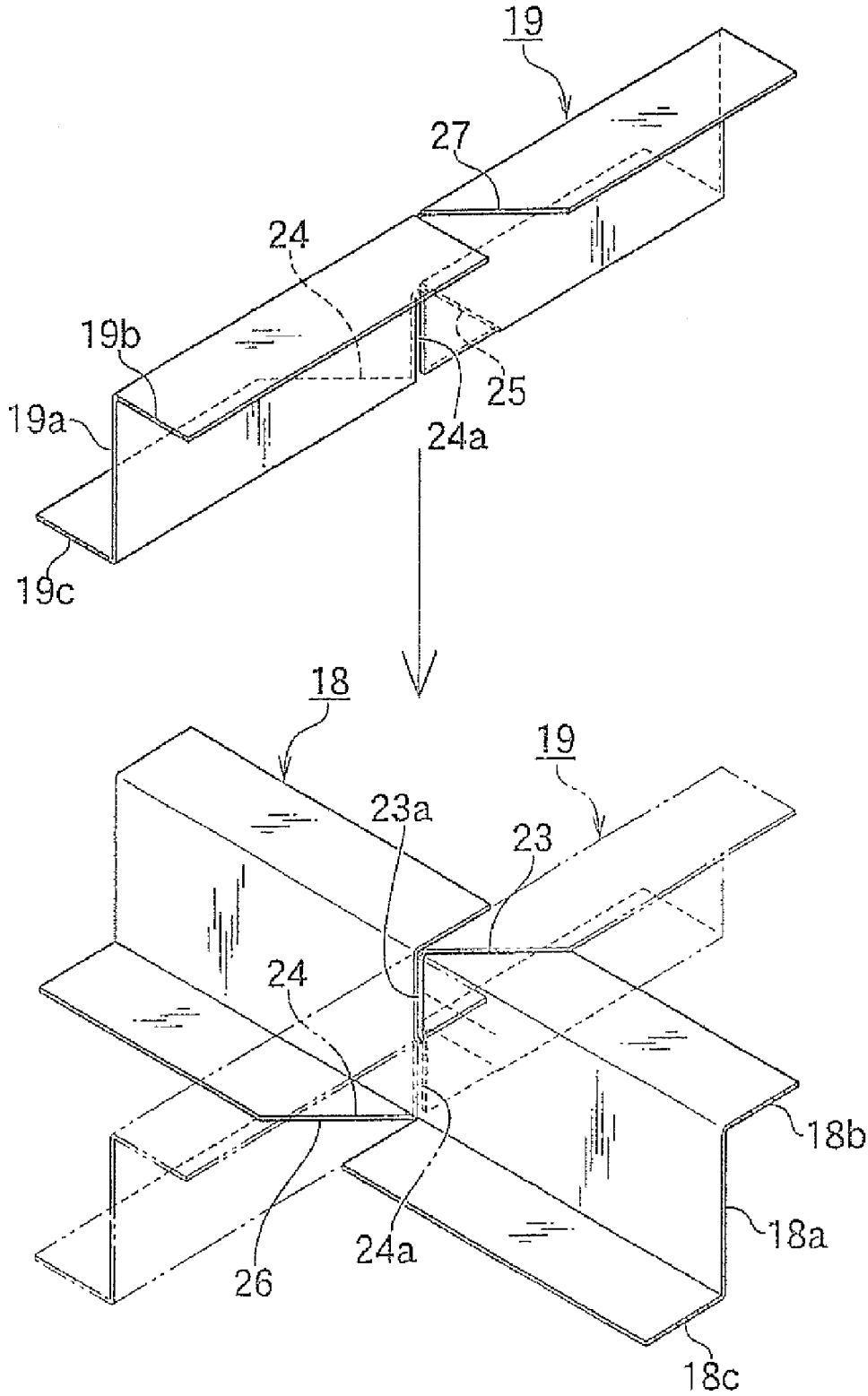
FIG. 8 is an exploded perspective view of the reinforcing frame.

FIG. 5 is a partially enlarged perspective view of the second embodiment of a top board according to the present invention seen from below; FIG. 6 is an enlarged sectional view taken and seen along the line VI-VI in FIG. 5; FIG. 7 is an exploded perspective view of a reinforcing frame and a bottom cover mounted to the top board in FIG. 5 upside down; and FIG. 8 is an exploded perspective view of the reinforcing frame.

In FIG. 5, the top board 12 in this embodiment comprises a top board body 13, a reinforcing frame 14 and a bottom cover 15.

In FIGS. 6 and 7, the top board body 13 has a downward portion 17 extending downward from the periphery of a base 16. The lower end of the downward portion 17 is bent inward like L to form a standing portion 17*a*, so that the top board body 13 is formed like a box having a lower opening.

The reinforcing frame 14 comprises a plurality of lateral reinforcements 18 extending in a forward and rearward direction; and a plurality of longitudinal reinforcements 19 extending in a right and left direction crossed to the lateral reinforcements 18.

The lateral reinforcement 18 comprises a vertical portion 18*a* and a pair of horizontal portions 18*b*,18*c* extending oppositely from the upper and lower ends of the vertical portion 18*a*. The lateral reinforcement 18 is made of extruded material having a Z-like cross-section.

As well as the lateral reinforcement 18, the longitudinal reinforcements 19 comprises a vertical portion 19*a* and a pair of horizontal portions 19*b*,19*c* extending oppositely from the upper and lower ends of the vertical portion 19*a*. The longitudinal reinforcement 19 is made of extruded material having a Z-like cross-section.

In FIGS. 6 and 7, the bottom cover 15 has an upward portion 21 extending from the periphery of a cover base 20 and is formed like a box having an upper opening.

The cover base 20 has a plurality of welding holes 22 through which a welding gun (not shown) can be put at positions corresponding to the lateral and longitudinal reinforcements 18,19 arranged like a lattice.

In order that the lateral reinforcements 18 are disposed with the longitudinal reinforcements 19 like a lattice in the reinforcing frame 14, in FIG. 8, there is formed a first V-like notch 23 having a first slit 23*a* extending from the upper end of the vertical portion 18*a* including the horizontal portion 18*b*.

Meanwhile, there is formed a second V-like notch 24 having a second slit 24*a* extending from the lower end of the vertical portion 19*a* including the lower horizontal portion 19*c*. A third notch 25 joined to the second notch 24 is formed so that the upper horizontal portion 18*b* of the lateral reinforcement 18 can be put in the third notch 25.

Into the first notch 23 of the lateral reinforcement 18, the second notch 24 of the longitudinal reinforcement 19 is put through the third notch 25 from above. The first slit 23*a* engages with the second slit 24*a* to allow the lateral reinforcement 18 to engage with the longitudinal reinforcement 19 like a lattice.

A fourth notch 26 of the lower horizontal portion 18*c* of the lateral reinforcement 18 is fitted with the second notch 24 of the longitudinal reinforcement 19.

The upper horizontal portion 19*b* of the longitudinal reinforcement 19 has a fifth notch 27 which fits with the first notch 23 of the lateral reinforcement 18. The engagement allows the upper and lower horizontal portions 18*b*,18*c* of the lateral reinforcement 18 to become coplanar with the upper and lower horizontal portions 19*b*,19*c* of the longitudinal reinforcement 19.

In FIG. 6, between an outer side 14*a* of the reinforcement frame 14 and the inner side of the standing portion 17*a* of the downward portion 17 extending from the periphery of the base 16 of the top board body 13, there is formed a gap "a" slightly wider than a thickness of the upward portion 21 of the bottom cover 21. The bottom cover 15 is fixed to the top board body 13 while the upward portion 21 of the bottom cover 15 is disposed in the gap "a".

To assemble the top board 12, in FIG. 7, on the lower surface of the inverted top board body 13, a plurality of lateral reinforcements 18 is disposed at regular spacings and connected to a plurality of longitudinal reinforcements 19 like a lattice.

The gap "a" is formed between the inner side of the standing portion 17 of the top board body 13 and the outer side 14*a* of the reinforcing frame 14 to be slightly wider than the thickness of the upward portion 21 of the bottom cover 15.

In the top board body 13 to which the reinforcing frame 14 is mounted, the bottom cover 15 is put upside down and the upward portion 21 of the bottom cover 21 is inserted in the gap "a", so that the bottom cover 15 is mounted.

Through the welding hole 22 of the bottom cover 15, the welding gun (not shown) is put, and at least one of the lateral and longitudinal reinforcements 18,19 is fixed to the lower surface of the base 16 by spot welding. And the bottom cover 15 is fixed to the reinforcing frame 14 by spot welding or plug welding or with screws.

Thus, the lower opening of the top board body 13 is closed with the bottom cover 15, so that the reinforcing frame 14 is hidden by the bottom cover 15.

In the embodiment, in the reinforcing frame 14, a plurality of reinforcements 18 is crossed with a plurality of reinforcements 19 like a lattice thereby improving strength of the top board 12 and reducing a vibrating surface. Thus, abnormal noises are reduced.

In the reinforcing frame 14, the notches 23,26 and 24,25,27 respectively formed in the lateral and longitudinal reinforcements 18,19 are engaged with each other and the slit 23*a* is engaged with the slit 24*a* thereby improving strength of the top board 12 further and certainly assembling the lateral and longitudinal reinforcements 18 and 19 with simple structure.

Figure 9:
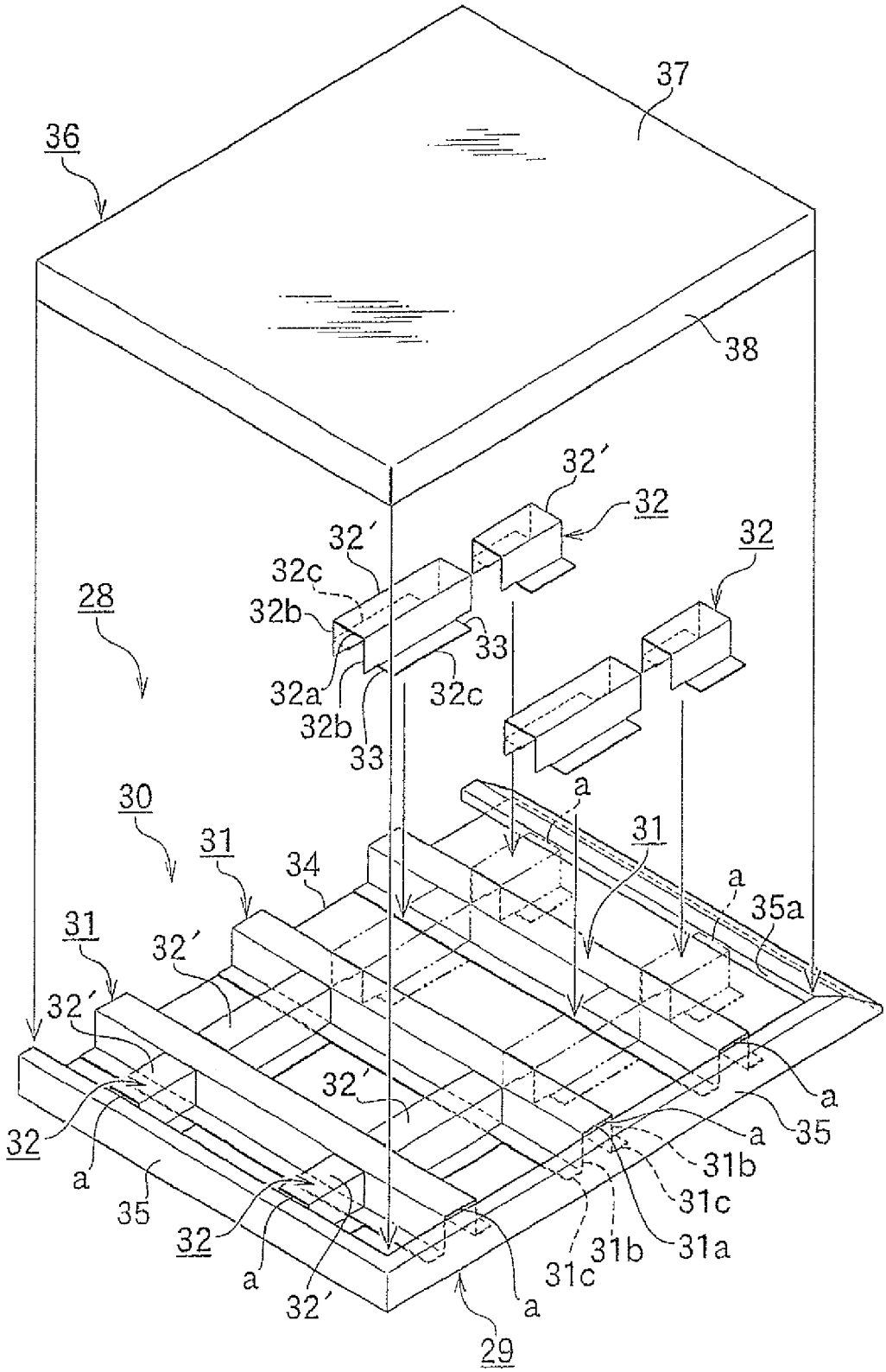
FIG. 9 is an exploded perspective view showing how to assemble a reinforcing frame to a top board in the third embodiment upside down.
Figure 10:
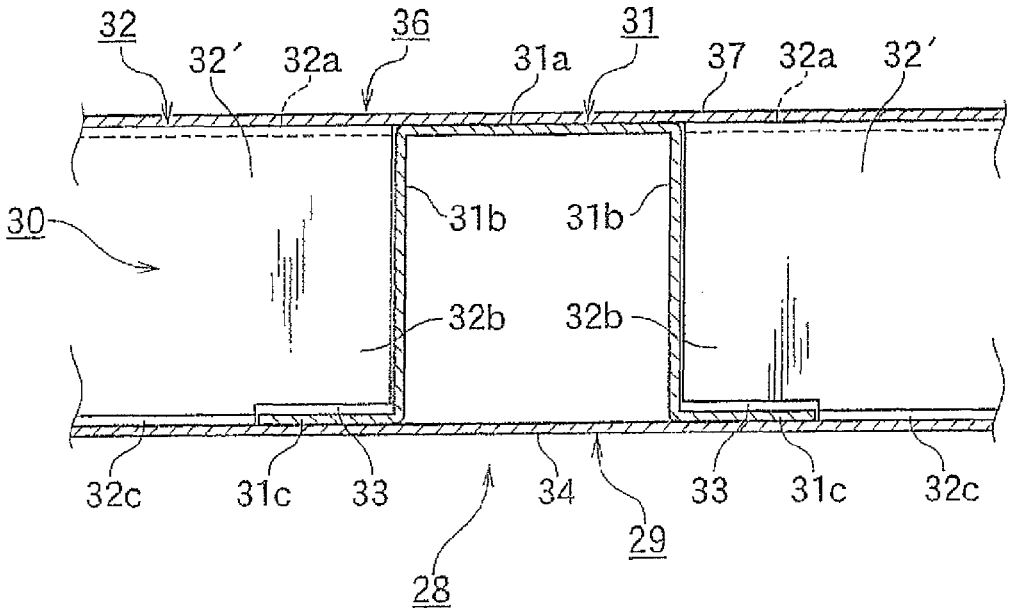
FIG. 10 is a vertical sectional view showing how to assemble the reinforcing frame to a top board.

FIG. 9 is an exploded perspective view showing assembling of a reinforcing frame to the top board and a bottom cover upside down, and FIG. 10 is an enlarged vertical sectional view showing mounting of a reinforcing frame to the top board and the bottom cover.

In FIG. 9, the reinforcing frame 30 fixed on the lower surface 29 of the top board 28 comprises a plurality of lateral reinforcements 31 extending in a forward and rearward direction and a plurality of longitudinal reinforcements 32 directed in a right and left direction, arranged to each other like a lattice.

The reinforcements 31,32 comprise lower horizontal portions 31*a*,32*a*, vertical portions 31*b*,32*b* extending upward from the lower horizontal portions 31*a*,32*a* respectively; and upper horizontal portions 31*c*,32*c* extending outward from the vertical portions 31*a*,32*a* respectively, and has the same shape of a V-like cross section.

The longitudinal reinforcement 32 is divided into a plurality of divided reinforcements 32' which are disposed between the adjacent lateral reinforcements 31 and 31.

Cutaway portions 33,33 are formed respectively at each end of the upper horizontal portions 32*c*,32*c* of each of the divided reinforcements 32'.

In FIG. 10, the upper horizontal portions 31*c*,31*c* are engaged in the cutaway portions 33,33 of the lateral reinforcement 31, so that the lower horizontal portions 31*a*,32*a* of the reinforcements 31,32 are coplanar with each other.

Between the inner side of a standing portion 35*a* of a downward portion 35 extending from the periphery of a base 34 of the top board body 29 and the outer sides of the lateral and longitudinal reinforcements 31,32 of the reinforcing frame 30, there is formed a gap "a" slightly wider than a thickness of an upward portion 38 extending from the periphery of a cover base 37 of a bottom cover 36. In the gap "a", the upward portion 38 of the bottom cover 36 is put.

For assembling of the top board 28, the lateral reinforcements 31 and the longitudinal reinforcements 32 of the reinforcing frame 30 are fixed on the lower surface of the top board body 29 by spot welding.

Then, into the gap "a", the upward portion 38 of the bottom cover 36 is put. The bottom cover 36 is mounted on the lower surface of the top board body 29 to allow the reinforcing frame 30 to be covered and fixed to the reinforcing frame 30 by spot welding or plug welding or with screws.

In this embodiment, the longitudinal reinforcement 32 is divided into a plurality of parts which are disposed between the adjacent lateral reinforcements 31 and 31. The lateral and longitudinal reinforcements 31,32 are fixed on the lower surface of the base 34 of the top board body 29. The bottom cover 36 is mounted under the top board body 29 and fixed to the reinforcements 31,32.

The reinforcements 31,32 comprise the lower horizontal portions 31*a*,32*a*, the vertical portions 31*b*,32*b* extending upward from the lower horizontal portions 31*a*,32*a*, and upper horizontal portions 31*c*,32*c* extending horizontally from the vertical portions 31*b*,32*b* to have a U-like cross section. The lower surfaces of the lower horizontal portions 31*a*,32*a* of the reinforcements 31,32 are coplanar with each other to allow the reinforcing frame 30 to be mounted to the top board body 29 firmly.

Figure 11:
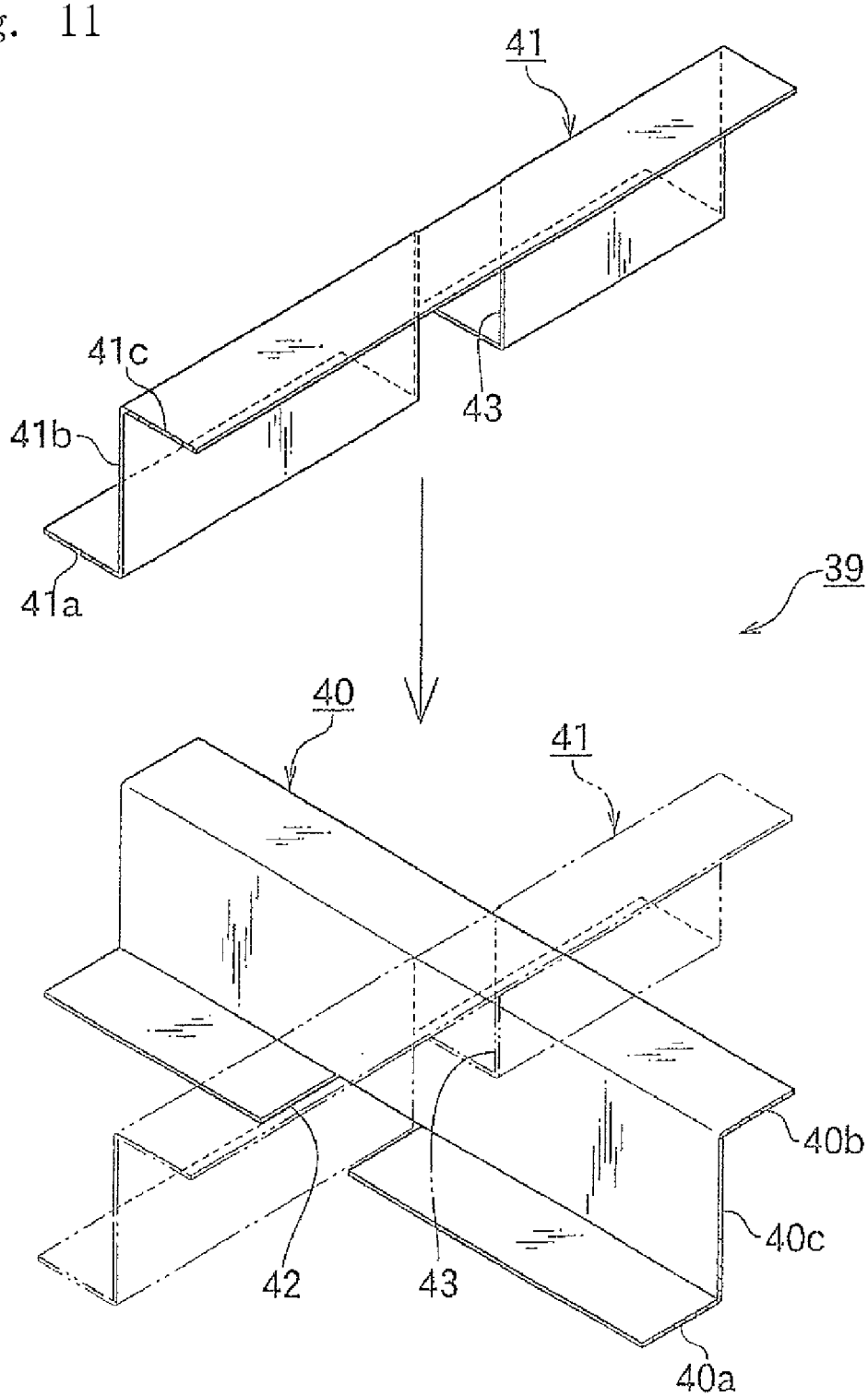
FIG. 11 is an exploded perspective view of a reinforcing frame in the fourth embodiment.

FIG. 11 is an exploded perspective view showing a reinforcing frame in the fourth embodiment of the present invention.

In FIG. 11, the reinforcing frame 39 has the same cross section as those of the lateral and longitudinal reinforcements 18,19 in the second embodiment. In the middle of the lower horizontal portion 40*a* of a lateral reinforcement 40, there is formed a cutaway portion 42 that engages with the lower horizontal portion 41*a* of a longitudinal reinforcement 41.

In the middle of the longitudinal reinforcement 41, there is formed an L-sectioned cutaway portion 43 extending from the lower horizontal portion 41*a* to the upper horizontal portion 41*c* through the vertical portion 41*b*.

The cutaway portion 43 is engaged with the upper horizontal portion 40*a* of the lateral reinforcement 40 though the vertical portion 40*c*.

The upper horizontal portion 41*c* of the longitudinal reinforcement 41 contacts the upper horizontal portion 40*b* of the lateral reinforcement 30 to allow the reinforcements 40 to be connected with the reinforcements 41 like a lattice.

The upper horizontal portion 41*a* of the longitudinal reinforcement 41 is engaged with the cutaway portion 42 of the upper horizontal portion 40*a* of the lateral reinforcement 40, so that the lower surfaces of the upper horizontal portions 40*a*,41*a* of the reinforcements 40,41 are allowed to become coplanar with each other.

Figure 12:
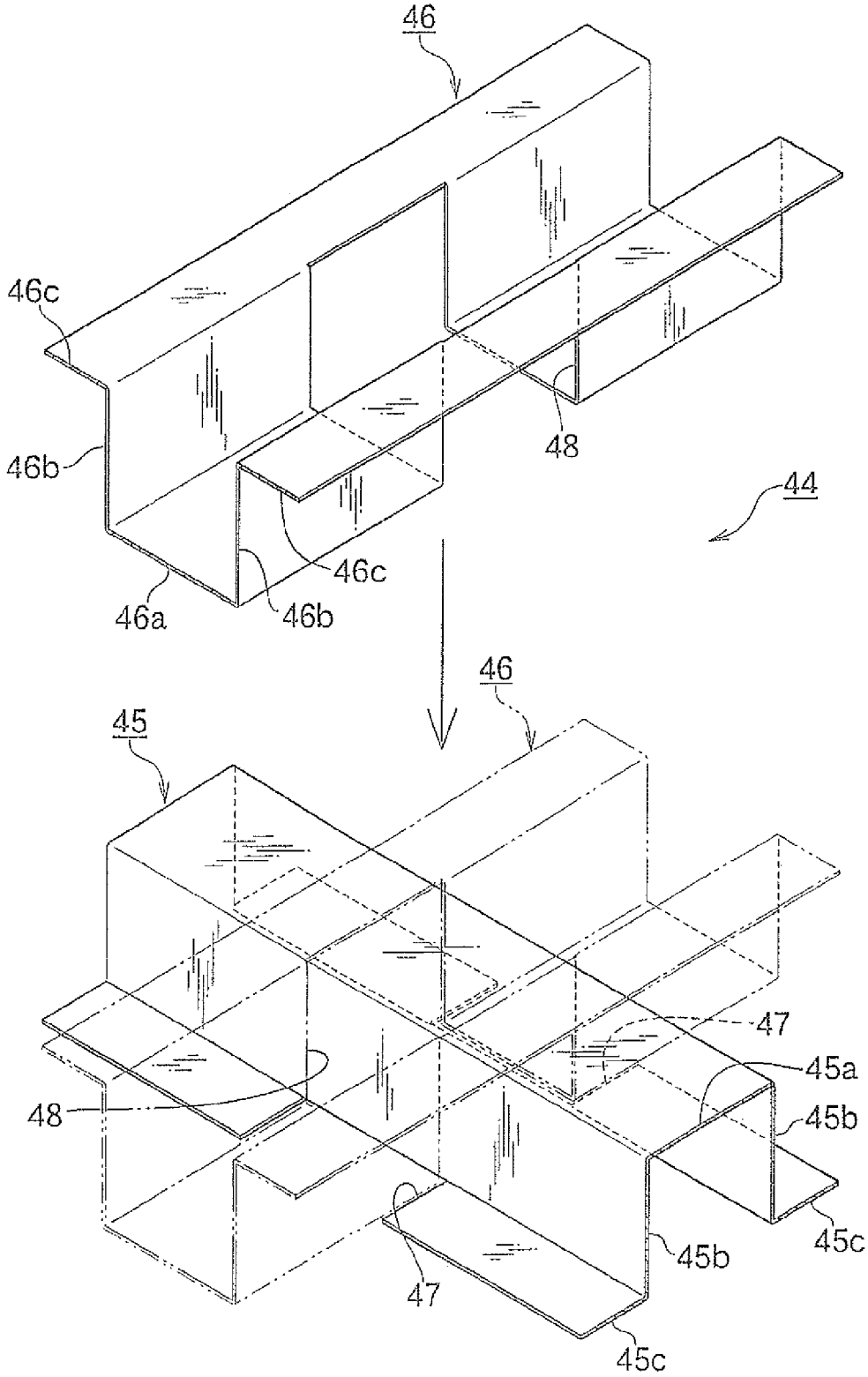
FIG. 12 is an exploded perspective view of a reinforcing frame in the fifth embodiment.

FIG. 12 is an exploded perspective view of a reinforcing frame in the fifth embodiment of the present invention.

In FIG. 12, a lateral reinforcement 45 of the reinforcing frame 44 comprises an upper horizontal portion 45*a*; horizontal portions 45*b*,45*b* extending downward from the upper horizontal portion 45*a*, and lower horizontal portions 45*c*,45*c* extending horizontally from the vertical portions 45*b*,45*b* to form an inverted U-like cross section.

A longitudinal reinforcement 46 comprises a lower horizontal portion 46*a*; vertical portions 46*b*,46*b* extending upward from the lower horizontal portion 46*a*; and upper horizontal portions 46*c*,46*c* extending outward from the upper ends of the vertical portions 46*b*,46*b* to form an inverted U-like cross section.

In the middle of the lower horizontal portions 45*c*,45*c* of the lateral reinforcement 45, there is formed a U-sectioned cutaway portion 48 extending from the lower horizontal portion 46*a* to the upper horizontal portion 46*c*,46*c* through the vertical portions 46*b*,46*b*.

The cutaway portion 48 is allowed to engage with the upper horizontal portion 45*a* of the lateral reinforcement 45 through the vertical portions 45*b*,45*b*.

The upper horizontal portions 46*c*,46*c* of the longitudinal reinforcement 46 is allowed to contact the upper horizontal portion 45*a* of the lateral reinforcement 45 to enable the reinforcements 45 and 46 to be connected like a lattice.

The lower horizontal portion 46*a* of the longitudinal reinforcement 46 is engaged with the cutaway portions 47,47 formed in the lower horizontal portions 45*c*,45*c* of the lateral reinforcement 45, so that the lower horizontal portion 45*c* of the reinforcement 45 is allowed to become coplanar with the lower horizontal portion 46*a* of the reinforcement 46.

What is claimed is:

1. A top board structure comprising a working surface in office furniture, the top board structure comprising:

a base made of sheet metal, and comprising the working surface on an upper surface and a downward portion extending downward from a periphery of the base; a flange extending inwardly from the bottom end of the downward portion, parallel to the base;

wherein a standing portion vertically extends upward at an inner end of the flange;

a reinforcing frame fixed on a lower surface of the base and comprising a longitudinal reinforcement extending in a right and left direction of the top board structure and a lateral reinforcement extending in a forward and rearward direction of the top board structure, a gap being formed between an inner side of the standing portion and an outer side of the reinforcing frame; and a bottom cover comprising a cover base and an upward portion extending upward from a periphery of the cover base, the bottom cover having an upper opening, the bottom cover being fixed to the reinforcing frame while the upward portion of the bottom cover is disposed in the gap, wherein the gap is slightly wider than a thickness of the upward portion of the bottom cover.

2. The top board structure of claim 1, wherein the longitudinal reinforcement or lateral reinforcement is disposed toward an outer periphery of the reinforcing frame, wherein a second gap is formed between an inner partition wall of the reinforcing frame and an inner side of the downward portion of the base; and another upward portion of the bottom cover extends in the second gap, and the second gap is slightly wider than the other upward portion of the bottom cover.

3. The top board structure of claim 1, wherein a plurality of longitudinal and lateral reinforcements are crossed to each other and arranged like a lattice.

4. The top board structure of claim 1, wherein one of the longitudinal and lateral reinforcements has a notch and a slit in the middle, the other having a notch and a slit in the middle so that one of the reinforcements engages with the other.

5. The top board structure of claim 1, wherein one of the longitudinal and lateral reinforcements is divided into a plurality of divided reinforcements which are disposed between two of the other reinforcements.

6. The top board structure of claim 1, wherein one of the longitudinal and lateral reinforcements has an L-sectioned cutaway portion which engages with the other reinforcement.

7. The top board structure of claim 1, wherein one of the longitudinal and lateral reinforcements comprises a U-like section, the other comprising an inverted U-like section, a cutaway portion being formed in the middle of one of the reinforcements to engage with the other reinforcement.

* * * * *